US005171730A

United States Patent [19]

Morita et al.

[11] Patent Number: 5,171,730

[45] Date of Patent: Dec. 15, 1992

[54] HEAT-SENSITIVE RECORDING PAPER

[75] Inventors: Yasuyoshi Morita, Saitama; Masaaki Matsuoka, Tokyo, both of Japan

[73] Assignee: Oji Paper Co., Ltd., Tokyo, Japan

[21] Appl. No.: 754,319

[22] Filed: Sep. 4, 1991

Related U.S. Application Data

[63] Continuation of Ser. No. 440,373, Nov. 22, 1989, abandoned.

[30] Foreign Application Priority Data

Nov. 24, 1988 [JP] Japan ..... 63-297015

[51] Int. Cl.[5] ..... B41M 5/40

[52] U.S. Cl. ..... 503/207; 503/200; 503/226

[58] Field of Search ..... 503/200, 207, 226

[56] References Cited

U.S. PATENT DOCUMENTS 2,419,207 4/1943 Fisher ..... 428/195
4,012,543 3/1977 Ranger et al. ..... 427/361

FOREIGN PATENT DOCUMENTS 190875 8/1986 European Pat. Off. ..... 428/195
54-96052 7/1979 Japan ..... 503/200
2183354 6/1987 United Kingdom ..... 503/200

OTHER PUBLICATIONS

Patent Abstracts of Japan vol. 9, No. 3, (M-349)(1726) Jan. 9, 1985.

Abstract Bulletin of the Institute of Paper Chemistry, vol. 54, No. 8, Feb. 1984, p. 975, abstract no. 9149, Appleton, Wis., US.

Patent Abstracts of Japan vol. 10, No. 295 (M-523)(2351) Oct. 7, 1986 & JP-A-61 108581 (Ricoh Co Ltd) May 27 1986, * the whole document *.

*Primary Examiner*—Pamela R. Schwartz

*Attorney, Agent, or Firm*—Wenderoth, Lind & Ponack

[57] ABSTRACT

In a heat-sensitive recording paper having a heat-sensitive color-forming layer formed on substrate paper, said substrate paper is impregnated with pigment particles in its surface and said pigment particles are made to present between surface fibers or said substrate paper for the purpose of providing high sensitivity without causing any undesired transfer of tailings to the thermal head.

5 Claims, No Drawings

HEAT-SENSITIVE RECORDING PAPER

This application is a continuation of now abandoned application, Ser. No. 07/440,373 filed on Nov. 22, 1989.

BACKGROUND OF THE INVENTION

The present invention relates to heat-sensitive recording paper, in particular, one having fast thermal response and which will cause reduced transfer of tailings to the thermal head.

Because of simplicity in the mechanism of color image formation by heating and the relative compactness of the recording apparatus with which it is used, heat-sensitive recording paper has been used extensively in various applications. As the use of heat-sensitive recording paper is expanding, the demand for reduced transfer of tailings to the thermal head and for higher sensitivity is also becoming more strict.

Conventional heat-sensitive recording paper has clay, talc and calcium carbonate incorporated in substrate paper. The substrate paper is weak in its ability to absorb the components of the heat-sensitive layer that melt upon heating and its capability of suppressing the transfer of tailings to the thermal head is almost nil. Thus, pigments capable of absorbing high oil contents have so far been incorporated in either the heat-sensitive color-forming layer or the undercoat layer or the substrate paper itself. For instance, Japanese Patent Publication No. 61-56118 and Japanese Patent Public Disclosure No. 59-155097 have proposed that pigments of high oil absorption be contained in the undercoat layer.

However, the use of such high oil-absorption pigments in the undercoat layer has the disadvantage that the components of the heat-sensitive color-forming layer that have been melted upon printing with high energy will be absorbed by the undercoat layer to cause occasional decrease in color density. To avoid this problem, it has been proposed that pigments of low oil absorption rather than high oil absorption be used in the undercoat layer (Japanese Patent Public Disclosure Nos. 61-139485 and 61-237683). However, if such low oil absorption pigments are used in the undercoat layer, the transfer of tailings to the thermal head will increase, thereby damaging the surface of heat-sensitive recording paper or causing printing defects such as low print density. Therefore, the previous attempts directed to the improvement of the undercoat layer, whether by incorporating high oil absorption pigments or by using low oil absorption pigments, have failed to attain heat-sensitive recording paper having good balance between sensitivity and resistance to transfer of tailings to the thermal head.

A method has also been proposed that relies upon incorporating high oil-absorption pigments in the substrate paper (Japanese Patent Public Disclosure No. 61-68291). However, this approach is not effective unless the pigments are loaded in large amounts but then the strength of the recording paper produced will inevitably decrease.

SUMMARY OF THE INVENTION

An object, therefore, of the present invention is to provide heat-sensitive recording paper that has fast thermal response, that produces high color density and that causes reduced transfer of tailings to the thermal head.

As a result of various studies conducted in order to attain this object, the present inventors found that it would be more effective to provide a small amount of pigment between the substrate paper and a leuco dye containing color-forming layer rather than providing an undercoat layer on the substrate paper. More specifically, the present inventors found that with the same pigment used in the undercoat layer of heat-sensitive recording paper, the transfer of tailings to the thermal head would decrease as the air permeability of the undercoat layer decreased. They also found that this effect became more conspicuous when the air permeability of the substrate paper was less than 100 seconds as measured with an Oken type air permeability meter, with even better results being attained when the value was less than 50 seconds. The air permeability of paper is an index of the ease with which air can pass through the paper and is proportional to the void volume of the paper. Thus, it is considered to be related to the absorbability of fusible components in the heat-sensitive color-forming layer.

If an undercoat layer is provided on substrate paper, the overall air permeability will unavoidably decrease compared to the substrate paper per se. However, if a heat-sensitive color-forming layer is directly formed on the substrate paper, the transfer of tailings to the thermal head will also increase because the paper fibers have low affinity for the fusible components in the heat-sensitive color-forming layer.

Thus, the present inventors conducted various studies in order to realize substrate paper (support) that had an air permeability close to that of substrate paper and which had high affinity for the fusible components in the heat-sensitive color-forming layer. As a result, the present inventors found that when the surface of substrate paper was impregnated with a pigment in a dry weight of at least 1 $g/m^2$, the air permeability of the substrate paper decreased, resulting in an increase in the transfer of tailings to the thermal head but, in contrast, when it was impregnated with a pigment having a dry weight of less than 1 $g/m^2$, a decrease in the air permeability of substrate paper can be prevented, resulting in a decrease in the transfer of tailings to the thermal head.

DETAILED DESCRIPTION OF THE INVENTION

The particles of pigment to be used should not be so large as to file up voids in the substrate paper and their size is preferably in the range of 0.1–2 μm. In order to improve the pigment's affinity for the fusible components in the heat-sensitive color-forming layer, it preferably has an oil absorption of at least 120 ml/100 g as measured in accordance with JIS K 5101. Specific examples of pigments that have this level of oil absorbing capability include calcium carbonate, barium sulfate, titanium oxide, talc, pyrophyllite, kaolin, calcined kaolin, aluminum hydroxide, aluminum oxide, magnesium silicate, calcium silicate, white carbon, urea-formaldehyde resin powder, polyethylene resin powder, etc. These pigments may be used either on their own or as admixtures.

On the condition that the intended object of the present invention should not be marred, pigments having an oil absorption of less than 120 mg/100 g may be incorporated in amounts which are usually less than 50 wt%.

These pigments should be impregnated only into the surface of substrate paper. If they are impregnated in the entire bulk of substrate paper, its void volume will decrease to result in lower sensitivity. The depth of impregnation is usually no more than a third of the thickness of substrate paper but this is not the requirement that must be satisfied in a strict way. The degree of pigment impregnation is preferably less than about 1 g/m$^2$. Thus, conventional coating machines may be used to have pigment particles disposed between fibers on the surface of substrate paper, but more preferably, the pigment particles are loaded by spraying over wire parts or by means of a size press during the making of substrate paper.

Any conventional adhesives may be used in incorporating the pigments in substrate paper and specific examples include: polyvinyl alcohols of various molecular weights; starch and its derivatives; cellulose derivatives such as methoxy cellulose, carboxymethyl cellulose, methyl cellulose and ethyl cellulose; water-soluble polymers such as poly(sodium acrylate), poly(vinylpyrrolidone), acrylamide/acrylate ester copolymer, acrylamide/acrylate ester/methacrylic acid terpolymer, alkali salts of styrene/maleic anhydride copolymer, polyacrylamide, sodium alginate, gelatin and casein; and latices of polyvinyl acetate, polyurethane, styrene/butadiene copolymer, polyacrylic acid, polyacrylate ester, vinyl chloride/vinyl acetate copolymer, polybutyl methacrylate, ethylene/vinyl acetate copolymer, and styrene/butadiene/acrylic copolymer. Since the adhesives impair the air permeability of substrate paper, their use should be minimized and no more than 25 parts of adhesives are generally used per 100 parts of pigment, with 5–10 parts being particularly preferred.

The substrate paper to be used in the present invention may be made from either hardwood pulp or softwood pulp. If necessary, glass fiber and various kinds of synthetic pulp may be mixed to make the substrate paper The substrate paper permits easy entrance of pigments between fibers on the paper surface, so it is preferred to select substrate paper having a water absorption of no more than 30 g/m$^2$ as measured by the Cobb test (JIS P-8140). However, if the degree of sizing is too high, it becomes difficult to impregnate the substrate paper with pigments. Therefore, the water absorption should be at least 20 g/m$^2$ as measured by the Cobb test. Common sizes such as rosins, alkenyl succinates, alkylketene dimers, etc. may be used as internal sizes. These sizes may be fixed with such compounds as aluminum sulfate and cationic starch.

If necessary, the substrate paper may have incorporated therein the known pigments described above.

The sensitivity of heat-sensitive recording paper is determined by the efficiency with which the heat from the thermal head can be utilized by the heat-sensitive color-forming layer. Thus, the present inventors, noting the heat insulating property of substrate paper itself, studied the relation between the thickness of the substrate paper and its sensitivity. As a result, they found that the sensitivity of substrate paper wound increase with increasing thickness. In practical applications, however, the thickness of subsrate paper is limited by its compatibility with printing apparatus.

Substrate paper that is impregnated with a pigment in an amount of less than 1 g/m$^2$ on a dry weight basis in accordance with the present invention has substantially the same thickness as the substrate paper. Hence, in the absence of an undercoat layer, the thickness of the substrate paper can be increased by 7–10 μm which corresponds to the thickness of an undercoat and this contributes improved sensitivity. If the thickness of substrate paper is less than 60 μm, satisfactory sensitivity will not be attained. If the substrate paper is thicker than 70 μm, the paper roll diameter will be so much increased as to cause difficulty in setting the paper on the printing apparatus.

The following are typical examples of colorless or pale colored color-forming lactone compounds that can be used in the color-forming layer:

Crystal Violet Lactone
3-(N-ethyl-N-isopenthylamino)-6-methyl-7-anilinofluoran;
3-diethylamino-6-methyl-7-anilinofluoran;
3-diethylamino-6-methyl-7-(o,p-dimethylanilino)fluoran;
3-(N-ethyl-p-toluidino)-6-methyl-7-anilinofluoran;
3-pyrrolidino-6-methyl-7-anilinofluoran;
3-dibutylamino-6-methyl-7-anilinofluoran;
3-(N-cyclohexyl-N-methylamino)-6-methyl-7-anilinofluoran;
3-diethylamino-7-(o-chloroanilino)fluoran;
3-diethylamino-7-(m-trifluoromethylanilino)fluoran;
3-diethylamino-6-methyl-7-chlorofluoran;
3-diethylamino-6-methylfluoran;
3-cyclohexylamino-6-chlorofluoran.

Color developers made of phenols or organic acids may also be selected from along those known in the art and may be illustrated by the following:
bisphenol A;
benzyl p-hydroxybenzoate;
n-butyl di(4-hydroxyphenyl)acetate;
bisphenol S;
4-hydroxy-4'-isopropyloxydiphenylsulfone;
1,1-di(4-hydroxyphenyl)dichlorohexane;
1,7-di(hydroxyphenylthio)-3,5-dioxaheptane.

Heat-fusible organic compounds having melting points of 50°–150° C. may be used as sensitizers. They may also be selected from among known compounds as exemplified below:
phenyl p-hydroxynaphthoate;
p-benzylbiphenyl;
benzylnaphthyl ether;
dibenzyl terephthalate;
benzyl p-benzyloxybenzoate;
diphenyl carbonate;
ditolyl carbonate.

The organic or inorganic pigments to be used in the color-forming layer are not limited in terms of oil absorption or in any other particular way and may be exemplified by the following: calcium carbonate, silica, zinc oxide, titanium oxide, aluminum hydroxide, zinc hydroxide, barium sulfate, clay, talc, surface-treated fine particles of inorganic materials such as calcium carbonate and silica, and fine particles of organic materials such as ureaformaldehyde resin, styrene/methacrylic acid copolymer and polystyrene resin.

The heat-sensitive color-forming layer may also contain various waxes as required and they may be selected from among known examples such as paraffin, amide-based wax, bisimide-based wax and metal salts of higher aliphatic acids. Adhesives that can be used include: polyvinyl alcohols having various molecular weights; starch and its derivatives; cellulose derivatives such as methoxy cellulose, carboxymethyl cellulose, methyl cellulose, and ethyl cellulose; water-soluble polymers such as poly(sodium acrylate), poly(vinylpyrrolidone), acrylamide/acrylate ester copolymer, acrylamide/acrylate ester/methacrylic acid terpolymer, alkali salts of styrene/maleic anhydride copolymer, polyacrylamide, sodium alginate, gelatin and casein; and latices of polyvinyl acetate, polyurethane, styrene/butadiene copolymer, polyacrylic acid, poly(acrylate ester), vinyl chloride/vinyl acetate copolymer, polybutyl methacrylate, ethylene/vinyl acetate copolymer, styrene/butadiene/acrylic copolymer, etc.

The following examples are provided for the purpose of further illustrating the present invention but are in no way to be taken as limiting. Unless otherwise noted, all "parts" and "%" that appear hereinbelow are on a weight basis.

EXAMPLE 1

| | |
|---|---|
| Water | 100 parts |
| Synthetic silicic acid ("Nipsil" of Nippon Silica Industrial Co., Ltd.; oil absorption, 120 ml/100 g) | 20 parts |
| Poly(sodium acrylate) (Dispersant "Alon T-40" of Toagosei Chemical Co., Ltd.) | 0.3 parts |

These ingredients were mixed together with a homogenizer for 15 minutes to prepare a dispersion, which was mixed with 10 parts of 10% polyvinyl alcohol ("GL 05" of The Nippon Synthetic Chemical Industry Co., Ltd.) to prepare a liquid impregnant. This impregnant was impregnated (0.5 g/m$^2$) in fine paper (air permeability, 35 seconds; thickness, 65 μm) by means of a size press and dried.

In a separate step, the following two dispersions were prepared.

| (1) Dispersion A | |
|---|---|
| Crystal Violet lactone | 20 parts |
| Polyvinyl alcohol (10% aq. sol.) | 10 parts |
| Water | 70 parts |

The composition having this recipe was pulverized with a sand grinder to an average particle size of 1.5 μm.

| (2) Dispersion B | |
|---|---|
| Benzyl p-hydroxybenzoate | 20 parts |
| Polyvinyl alcohol (10% aq. sol.) | 10 parts |
| Water | 70 parts |

The composition having this recipe was pulverized with a sand grinder to an average particle size of 2 μm.

(3) Heat-Sensitive Color-Forming Layer

Dispersion A (75 parts), dispersion B (125 parts), calcium carbonate (30 parts), 10% polyvinyl alcohol (200 parts), 30% paraffin dispersion (17 parts) and 30% zinc stearate dispersion (17 parts) were mixed with stirring to prepare a coating solution of heat-sensitive color former. The solution was applied to the paper in a deposit of 4.5 g/m$^2$ on a dry basis and dried to prepare heat-sensitive recording paper.

EXAMPLE 2

| | |
|---|---|
| Water | 100 parts |
| Magnesium carbonate (product of Kamishima Chemical Co., Ltd.; oil absorption, 140 ml/100 g) | 20 parts |
| Poly(sodium acrylate) (Dispersant of Toagosei Chemical Co., Ltd.) | 0.3 parts |

These ingredients were mixed together with a homogenizer for 15 minutes to prepare a dispersion, which was mixed with 10 parts of 10% polyvinyl alcohol ("GL 05" of The Nippon Synthetic Chemical Industry Co., Ltd.) to prepare a liquid impregnant. Using a size press, this impregnant was impregnated (0.5 g/m$^2$) in substrate paper of the same kind as used in Example 1 and dried. A heat-sensitive color-forming layer was formed as in Example 1 to make heat-sensitive recording paper.

EXAMPLE 3

| | |
|---|---|
| Water | 100 parts |
| Organic Pigment ("Chemibar" of Mitsui Petrochemical Industries, Ltd.; oil absorption, 250 ml/100 g) | 20 parts |
| Poly(sodium acrylate) (Dispersant of Toagosei Chemical Co., Ltd.) | 0.3 parts |

These ingredients were mixed together with a homogenizer for 15 minutes to prepare a dispersion, which was mixed with 10 parts of 10% polyvinyl alcohol ("GL 05" of The Nippon Synthetic Chemical Industry Co., Ltd.) to prepare a liquid impregnant. Using a size press, this impregnant was impregnated (0.5 g/m$^2$) in substrate paper of the same kind as used in Example 1 and dried. A heat-sensitive color-forming layer was formed as in Example 1 to make heat-sensitive recording paper.

COMPARATIVE EXAMPLE 1

Fine paper (air permeability, 35 seconds; thickness, 65 μm) of the same type as used in Example 1 was directly treated as in Example 1 to form a heat-sensitive color-forming layer, thereby making heat-sensitive recording paper.

COMPARATIVE EXAMPLE 2

Fine paper (air permeability, 35 seconds; thickness, 55 μm) was directly treated as in Example 1 to form a heat-sensitive color-forming layer, thereby making heat-sensitive recording paper.

COMPARATIVE EXAMPLE 3

| | |
|---|---|
| Water | 100 parts |
| Synthetic silicic acid ("Nipsil"; oil absorption, 120 ml/100 g) | 20 parts |
| Poly(sodium acrylate) (Dispersant "Alon T-40" of Toagosei Chemical Co., Ltd.) | 0.3 parts |

These ingredients were mixed together with a homogenizer for 15 minutes to prepare a dispersion, which was mixed with 10 parts of 10% polyvinyl alcohol ("GH 17" of The Nippon Synthetic Chemical Industry Co., Ltd.) to prepare an undercoating solution. This solution was applied to fine paper (air permeability, 35 seconds; thickness, 55 μm) in a deposit of 7 g/m$^2$ and dried. Thereafter, a coating solution of heat-sensitive color former that was prepared as in Example 1 was applied to the undercoat layer and dried to form a heat-sensitive color-forming layer, thereby making heat-sensitive recording paper.

The samples of heat-sensitive recording paper that were made in Examples 1–3 and Comparative Examples 1–3 were subjected to measurements of sensitivity and transfer of tailings to the thermal head. The results are shown in Table 1 below.

TABLE 1

| Sample No. | Air permeability of substrate paper (sec) | Thickness of heat-sensitive recording paper (μm) | Sensitivity | Tailings |
|---|---|---|---|---|
| Example | | | | |
| 1 | 40 | 68 | 1.25 | ○ |
| 2 | 45 | 69 | 1.27 | ○ |
| 3 | 50 | 68 | 1.26 | ○ |
| Comp. Example | | | | |
| 1 | 35 | 69 | 1.25 | X |
| 2 | 35 | 59 | 1.15 | X |
| 3 | 220 | 69 | 1.20 | Δ |

The measurements were conducted in the following manner.

(1) Sensitivity

The testing machine used was adapted from a commercial thermal facsimile. Under the conditions of 10 msec for the recording time per line and 8×8 dots/mm for the scanning density, pulse width was modulated so that 0.50 mJ of energy would be applied per dot. The number of lines printed was 64. The resulting color density was measured with a Macbeth densitometer Model RD-514 and used as a representative value of recording sensitivity.

(2) Transfer of Tailings

Tailings that were transferred to the thermal head were inspected visually and evaluated by the following criteria: O, tailings were negligible and acceptable for practical purposes; Δ, some tailings were transferred but they caused little problem in practice; X, extensive tailings made the operation inpracticable.

(3) Air permeability

Measured with an Oken type air permeability meter.

As the data in Table 1 shows, the samples of heat-sensitive recording paper prepared in accordance with the present invention using substrate paper having a pigment impregnated into substrate paper in an amount of less than 1 g/m$^2$ were more sensitive and caused less transfer of tailings to the thermal head than the comparative samples which had a heat-sensitive color-forming layer formed either directly on the substrate paper on the undercoat layer.

The present invention provides heat-sensitive recording paper that has fast thermal response and which shows high sensitivity without causing any undesired transfer of tailings to the thermal head.

What is claimed is:

1. A heat sensitive recording paper having a heat sensitive color-forming layer formed directly on a substrate paper, wherein said substrate paper consists of natural pulp, hardwood pulp or softwood pulp, said substrate paper being impregnated with pigment particles having a particle size range of 0.1–2 μm, said pigment particles having an oil absorption capacity of at least 120 ml/100 g as measured according to JIS K 5101, in its surface in a dry weight of less than 1 g/m$^2$ and said pigment particles being present between surface fibers on said substrate paper.

2. The heat-sensitive recording paper according to claim 1 in which the pigments are impregnated into the surface of the substrate by means of an adhesive in which the adhesive is used in an amount of no more than 25 parts per 100 parts by weight of the pigment particles.

3. The heat-sensitive recording paper according to claim 2 in which the adhesive is used in an amount of 5–10 parts per 100 parts of the pigment particles.

4. The heat-sensitive recording paper according to claim 3 in which substrate paper has a water absorption of between 20 g/m$^2$ and 30 g/m$^2$ as measured by the Cobb test.

5. The heat-sensitive recording paper according to claim 4 in which the substrate has a thickness of 60 μm to 70 μm.

* * * * *